United States Patent [19]

Hollfelder et al.

[11] 4,335,416

[45] Jun. 15, 1982

[54] TELEPHONE PROTECTOR MODULE HAVING FLAG INDICATOR

[75] Inventors: Thomas A. Hollfelder, Huntington; Paul V. De Luca, Plandome Manor, both of N.Y.

[73] Assignee: Porta Systems Corp., Syosset, N.Y.

[21] Appl. No.: 234,209

[22] Filed: Feb. 13, 1981

[51] Int. Cl.[3] ..... H02H 3/22

[52] U.S. Cl. ..... 361/119; 361/124; 337/34; 337/244

[58] Field of Search ..... 361/119, 124; 337/244, 337/240, 15, 28, 31, 32, 33, 34

[56] References Cited

U.S. PATENT DOCUMENTS

| | | | |
|---|---|---|---|
| 2,914,636 | 11/1959 | Rozacka | 337/244 |
| 3,879,696 | 4/1975 | Imasyo et al. | 337/244 |
| 3,947,730 | 3/1976 | De Luca et al. | 361/119 X |
| 4,091,435 | 5/1978 | Ahuja | 361/119 |

*Primary Examiner*—Patrick R. Salce

*Attorney, Agent, or Firm*—Charles E. Temko

[57] ABSTRACT

A heat sensitive telephone protector module of a type having visual indicator means to indicate the actuation of heat sensitive means upon the occurrence of excessive current flow. The module includes dual heat sensitive units for protecting the tip and ring circuits of an individual subscriber pair, and a single indicator unit which is outwardly projected from the module housing by action of either heat sensitive element.

3 Claims, 3 Drawing Figures

TELEPHONE PROTECTOR MODULE HAVING FLAG INDICATOR

BACKGROUND OF THE INVENTION

This invention relates generally to the field of telephone protector modules of a type adapted to protect the tip and ring circuits of an individual subscriber pair. Modules of this general type are known in the art, and are normally engaged upon a telephone protector block mounted upon a main frame in a telephone office. The invention lies in specific constructional details permitting economies of manufacture, and improved reliability in operation.

Devices of this type when installed are usually in juxtaposed relation on all sides relative to similar devices which serve to protect other subscriber pairs. Under such conditions, only an outer wall of the module housing is visible to service personnel, which wall usually mounts a small T-shaped handle which enables the module to be manually disengaged from the block.

In the De Luca et al. U.S. Pat. No. 3,947,730 granted Mar. 30, 1976 and assigned to the same assignee as the instant application, there is disclosed a gas tube type protector module which includes a single wad, and outer end of which projects through a bore in the handle to expose an outermost tip thereof when a single heat sensitive means is actuated. In the disclosed device, a single gaseous discharge tube protects both the tip and ring circuits, and heat developed in either part of the tube will actuate the single heat sensitive means to ground the tip and ring circuits.

However, the bulk of protector modules of this type are of the carbon arc variety with a separate heat sensitive means for each of the tip and ring circuits. In such construction, either heat sensitive means may become operative without affecting the condition of the other. U.S. Pat. No. 4,091,435 granted Apr. 23, 1978 to Om P. Ahuja, and assigned to the same assignee as the instant application, provides separate individual means for each circuit in the module, but has a disadvantage in that the end of the indicator projects through an opening in a housing wall rather than a bore in the handle supported by that wall, for the reason that the indicators are positioned such that they cannot extend through the handle. Since the indicators do not project past the outer surface of the handle, they are not readily visible to service personnel, and are correspondingly difficult to locate.

SUMMARY OF THE INVENTION

Briefly stated, the invention contemplates the provision of an improved module of the class described utilizing separate heat sensitive devices for tip and ring circuits, in which the actuation of either heat sensitive device will cause a single rod-like indicator means to project through a bore in the handle so as to be readily visible upon observing an entire group of similar modules on a telephone protector block. The indicator member has an inner end having a transversely extending planar member mounted thereon, and lying in the path of both heat sensitive elements while being free of positive interconnection with either of them. A spring urges the indicator member to retracted condition within the module housing so as to avoid the possibility of a false signal, the resilient force of the spring being overcome by actuation of either heat sensitive device.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
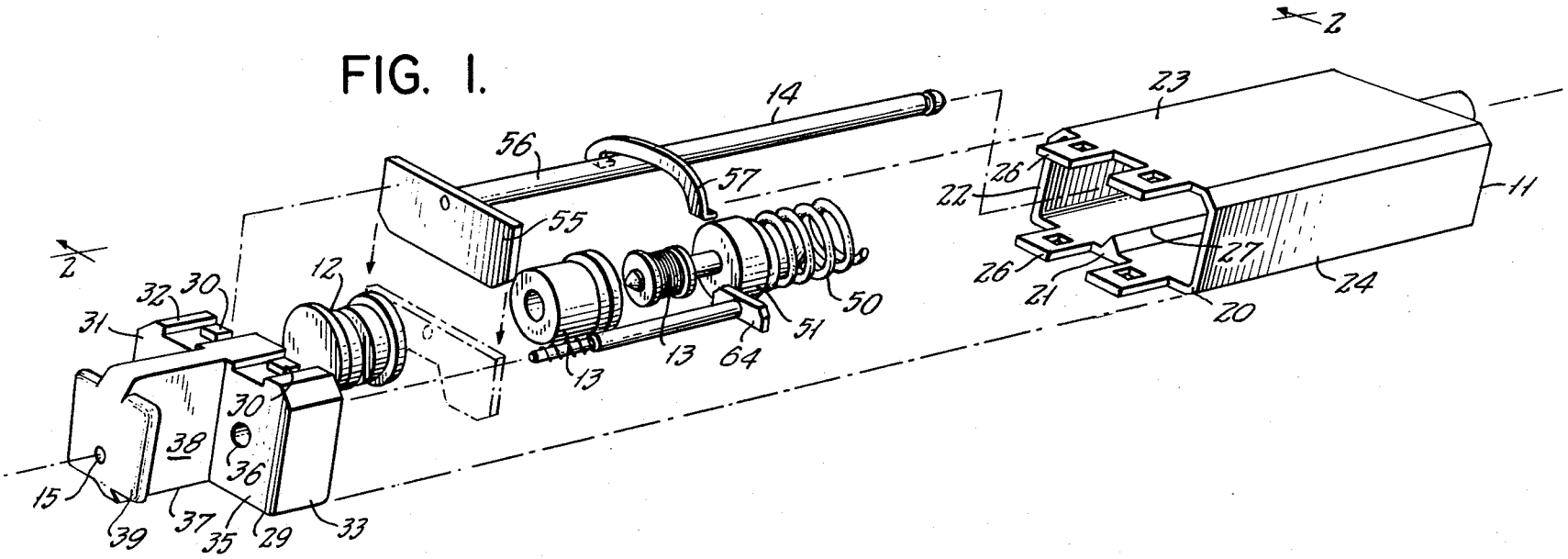
FIG. 1 is an exploded view in perspective of an embodiment of the invention, with certain component parts thereof removed for purposes of clarity.
Figure 2:
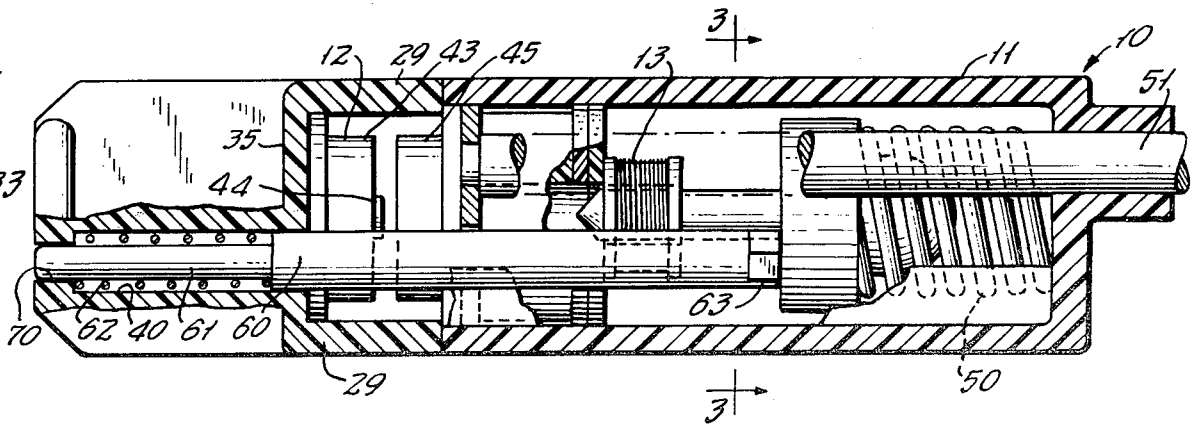
FIG. 2 is a transverse sectional view thereof, as seen from the plane 2—2 in FIG. 1.

In accordance with the invention, a protector module, generally indicated by reference character 10 comprises a casing element 11, a pair of carbon arc protector means 12, a corresponding pair of heat sensitive protector devices 13, grounding means 14 and flag indicator means 15.

The casing element 11 is generally conventional, including a hollow main body 20 formed by side walls 21, 22, 23 and 24; as well as an inner end wall (not shown). Projecting from an outer end are a plurality of engagement tabs 26. On an inner surface of the side wall 21 is a longitudinally extending projection which serves a guiding function hereinafter described.

Engaging the open end of the body 20 is a cap member 29 having projections 30 corresponding to the tabs 26. It is bounded by side walls 31, 32, 33 and 34 and an end wall 35 having one or more openings 36 for the engagement of test probes (not shown). A T-shaped handle 37 extends from the outer surface of the end wall 35, and includes a longitudinal member 38 and a transversely extending member 39. A centrally disposed bore 40 communicates with the interior of the body 20.

The carbon arc protector means 12 are conventional, each including a ceramic housing 43 mounting a cylindrical carbon 44 which coacts with a disc carbon 45 in known manner.

Disposed in line with the means 12 are the heat sensitive protector devices 13 which are of a type disclosed in the above-mentioned Ahuja Pat. No. 4,091,435. Each includes a relatively strong coil spring 50 which bears upon a movable flange 51.

The grounding means 14 is conventional, including a transversely extending ground plane member 55 mounting a longitudinally extending grounding terminal 56 which interconnects with a second grounding plane member 57. The details of this element are entirely conventional, and form no part of the present disclosure.

The flag indicator means 15 includes a longitudinally extending rod-like member 60, having an outer portion of reduced diameter 61 accommodating a surrounding relatively weak spring 62. An inner end 63 mounts a transversely extending member 64 including first and second extremities 65 and 66, respectively, each of which lies in the path of one of the flanges 51 whereby movement may be transmitted from the latter to the former. A V-shaped indentation 67 cooperates with the guiding projection 27 to prevent rotation of the means 15 about its own axis.

Figure 3:
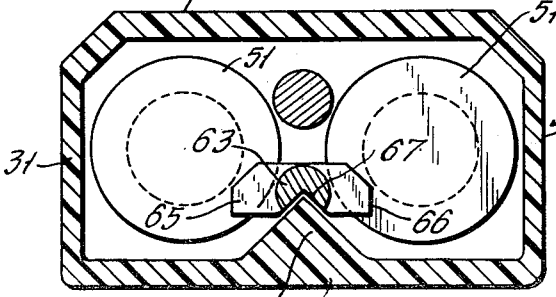
FIG. 3 is a longitudinal sectional view as seen from the plane 3—3 in FIG. 2.

As best seen in FIG. 3, the bore 40 communicates with a coaxially disposed counterbore 70 which accommodates the spring 62. The modulus of the spring 62 is considerably less than that of the springs 50, and is readily overcome upon actuation of either heat sensitive protector device 13.

The operation of the device will be apparent from a consideration of the drawings. Upon the "firing" of either device 13, the flange 51 will move leftwardly as seen in FIG. 1 in the drawing to contact an extremity of the transversely extending member 64 to result in the projection of the outer end of the rod-like member 60 projecting through the bore 40 in the handle 37. This movement is possible because the means 15 is not physically connected to the devices 13, and can receive an impetus from either device 13.

We wish it to be understood that we do not consider the invention limited to the precise details of structure shown and set forth in this specification, for obvious modifications will occur to those skilled in the art to which the invention pertains.

We claim:

1. In a telephone protector module, including a casing element having an outer end wall with a manually engageable handle thereon, first and second resilient heat sensitive protector devices disposed in mutually parallel relation within said protector module, each separately actuable upon the occurrence of an excessive current surge sufficient to melt a fused component thereof to longitudinally shift a movable component thereon, the improvement comprising: a single flag indicator means including an elongated longitudinally shiftable rod-like member and a transversely extending member mounted upon an inner end thereof, said transversely extending member having first and second extremities each lying in the path of movement of a movable component of a heat sensitive protector device, and being otherwise free of engagement therewith, resilient means urging said rod-like member inwardly of said casing element, said handle having a longitudinally extending bore therein, said rod-like member having an outer terminal slidably disposed within said bore, and selectively projectable outwardly of said bore upon actuation of either of said heat sensitive protector devices.

2. The improvement set forth in claim 1, further characterized in said resilient means including a coil spring surrounding said rod-like member, and disposed in a counterbore coaxially aligned with said bore in said handle.

3. The improvement set forth in claim 1, further characterized in the provision of guiding means on an inner surface of said casing element engaging said transversely extending member for preventing axial rotation thereof.

* * * * *